US006552286B2

(12) United States Patent
Yang et al.

(10) Patent No.: US 6,552,286 B2
(45) Date of Patent: Apr. 22, 2003

(54) HANDLE OPERATING MECHANISM OF CIRCUIT BREAKER

(75) Inventors: Ta-Jung Yang, Taoyuan (TW); Chang Ter-Hsiang, Taoyuan (TW)

(73) Assignee: Delta Electronics, Inc., Taiwan (CN)

( * ) Notice: Subject to any disclaimer, the term of this patent is extended or adjusted under 35 U.S.C. 154(b) by 63 days.

(21) Appl. No.: 09/918,142

(22) Filed: Jul. 30, 2001

(65) Prior Publication Data

US 2002/0158734 A1 Oct. 31, 2002

(30) Foreign Application Priority Data

Apr. 27, 2001 (TW) ..... 90206844 U

(51) Int. Cl.[7] ..... H01H 9/00

(52) U.S. Cl. ..... 200/330; 200/17 R; 200/50.32; 200/400

(58) Field of Search ..... 200/17 R, 18, 200/50.32, 400, 329–337

(56) References Cited

U.S. PATENT DOCUMENTS 4,308,441 A * 12/1981 Evans et al. ..... 200/335
4,760,220 A * 7/1988 Fritsch et al. ..... 200/50.11
4,873,404 A * 10/1989 Fritsch ..... 200/332
5,422,453 A * 6/1995 Smith et al. ..... 200/329
5,444,202 A * 8/1995 Zurcher ..... 200/400
5,648,646 A * 7/1997 Flegel ..... 200/50.32
5,914,467 A * 6/1999 Jonas et al. ..... 200/1 R
6,137,069 A * 10/2000 Casagrande et al. ..... 200/50.32

* cited by examiner

*Primary Examiner*—Michael Friedhofer
(74) *Attorney, Agent, or Firm*—Alston & Bird LLP

(57) ABSTRACT

A handle operating mechanism of a multi-pole circuit breaker is provided for operating a pivot handle thereof. The handle operating mechanism includes a fixed portion, a movable portion, a driven portion and a manual portion. The manual portion includes a stem with a first passage, a first connecting device coupled with the outside surface of a panel of an appliance and a second connecting device coupled with the driven portion, wherein the first connecting device is used as a fulcrum and the second connecting device moves along the first passage when the stem is rotated. The stem is rotated to drive the driven portion and the movable portion such that the pivot handle is securely held in one of an on position and an off position.

20 Claims, 6 Drawing Sheets

HANDLE OPERATING MECHANISM OF CIRCUIT BREAKER

FIELD OF THE INVENTION

The present invention relates to a handle operating mechanism, and more particularly to a handle operating mechanism of a multi-pole circuit breaker.

BACKGROUND OF THE INVENTION

A typical circuit breaker has a pivot handle which moves linearly between an on position and an off position. The pivot handle is connected to contacts within the circuit breaker through a spring powered toggle device. When the handle is switched to the on position, the contacts close for making an electrical connection. When the pivot handle is switched to the off position, the contacts separate from each other and thus the electrical connection is interrupted.

Generally, multi-pole circuit breakers are used for a communication power system because the power supply with low DC voltage (e.g. smaller than 100 Volts) and high current (e.g. greater than 500 Amperes) is required. FIG. 1 is a perspective view of a typical multi-pole circuit breaker, for example a six-pole circuit breaker 10. The circuit breaker 10 is typically mounted within a housing of a power distribution unit (PDU). In its installation, a pivot handle 11 of the circuit breaker 10 protrudes through an opening of the housing such that the pivot handle 11 can be operated manually. The protruding pivot handle 11 causes components of the circuit breaker 10 to be exposed to the environment with high sour gas and/or high humidity, which results in damage of the components or a short of the circuit. In addition, a considerably larger torque is needed to operate the pivot handle 11 of the multi-pole circuit breaker 10. Since the lever of the pivot handle 11 is not long enough, a high force is needed for an operator to operate the pivot handle 11.

Therefore, the present invention provides an improved handle operating mechanism so as to overcome the problems described above.

SUMMARY OF THE INVENTION

It is an object of the present invention to provide a handle operating mechanism of a multi-pole circuit breaker to avoid exposure of the breaker's components to an environment with high sour gas and/or high humidity.

It is another object of the present invention to provide a handle operating mechanism of a multi-pole circuit breaker with increased leverage.

In accordance with an aspect of the present invention, the handle operating mechanism is mounted on an electrical appliance. The handle operating mechanism includes a fixed portion, a movable portion, a driven portion and a manual portion. The fixed portion is coupled with the inside surface of a panel of the electrical appliance. The movable portion has an opening for passing a pivot handle of the circuit breaker therethrough. The driven portion is coupled with the movable portion. The manual portion includes a stem with a first passage, a first connecting device coupled with the outside surface of the panel and a second connecting device coupled with the driven portion, wherein the first connecting device is used as a fulcrum and the second connecting device moves along the first passage when the stem is rotated. The stem is rotated to drive the driven portion and the movable portion such that the pivot handle is securely held in one of an on position and an off position.

Preferably, the electrical appliance is a power distribution unit (PDU).

Preferably, the fixed portion includes a rectangular frame having a window in the center thereof.

Preferably, the driven portion includes a horizontal bar, a first stick and a second stick. The horizontal bar, the first stick and the second stick are coupled together via a third connecting device. The first stick is further coupled with the movable portion via a fourth connecting device, and the second stick is further coupled with the fixed portion via a fifth connecting device.

Preferably, each of the first connecting device, the second connecting device, the third connecting device, the fourth connecting device and the fifth connecting device is selected from an assembly of screw bolt and nut, or a pin.

Preferably, a side of the fixed portion further comprises at least a second passage.

Preferably, the movable portion further includes at least a sixth connecting device corresponding to the second passage. The sixth connecting device is selected from an assembly of screw bolt and nut, or a pin.

In accordance with another aspect of the present invention, there is provided a handle operating mechanism of a multi-pole circuit breaker mounted on a power distribution unit (PDU). The handle operating mechanism includes a fixed portion coupled with the inside surface of a panel of the power distribution unit (PDU) wherein the fixed portion includes a rectangular frame having a window in the center thereof, a movable portion having an opening for passing a pivot handle of the circuit breaker therethrough, a driven portion coupled with the movable portion wherein the driven portion comprising a horizontal bar, a first stick and a second stick, and a manual portion including a stem with a first passage, a first connecting device coupled with the outside surface of the panel and a second connecting device coupled with the driven portion, wherein the first connecting device is used as a fulcrum and the second connecting device moves along the first passage when the stem is rotated. The stem is rotated to drive the driven portion and the movable portion such that the pivot handle is securely held in one of an on position and an off position.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 3(*b*) is perspective view illustrating the handle operating mechanism is being operated from an off position to an on position according to the present invention;

FIG. 3(*c*) is perspective view illustrating the handle operating mechanism is securely held in an on position according to the present invention.

DETAILED DESCRIPTION OF THE PREFERRED EMBODIMENT

Figure 1:
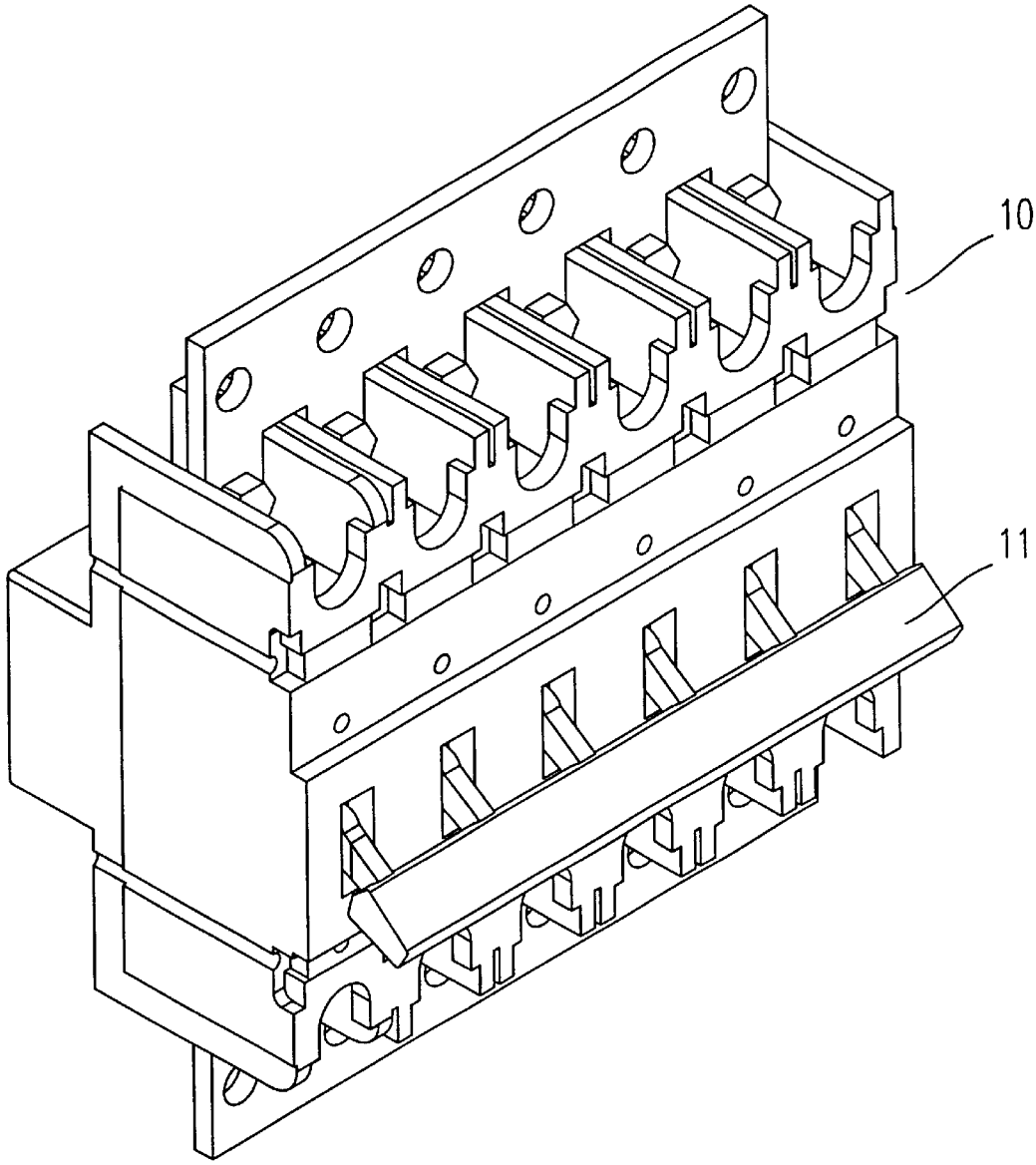
Fig. 1(PRIOR ART)
FIG. 1 is a perspective view illustrating a multi-pole circuit breaker according to the prior art.
Figure 2:
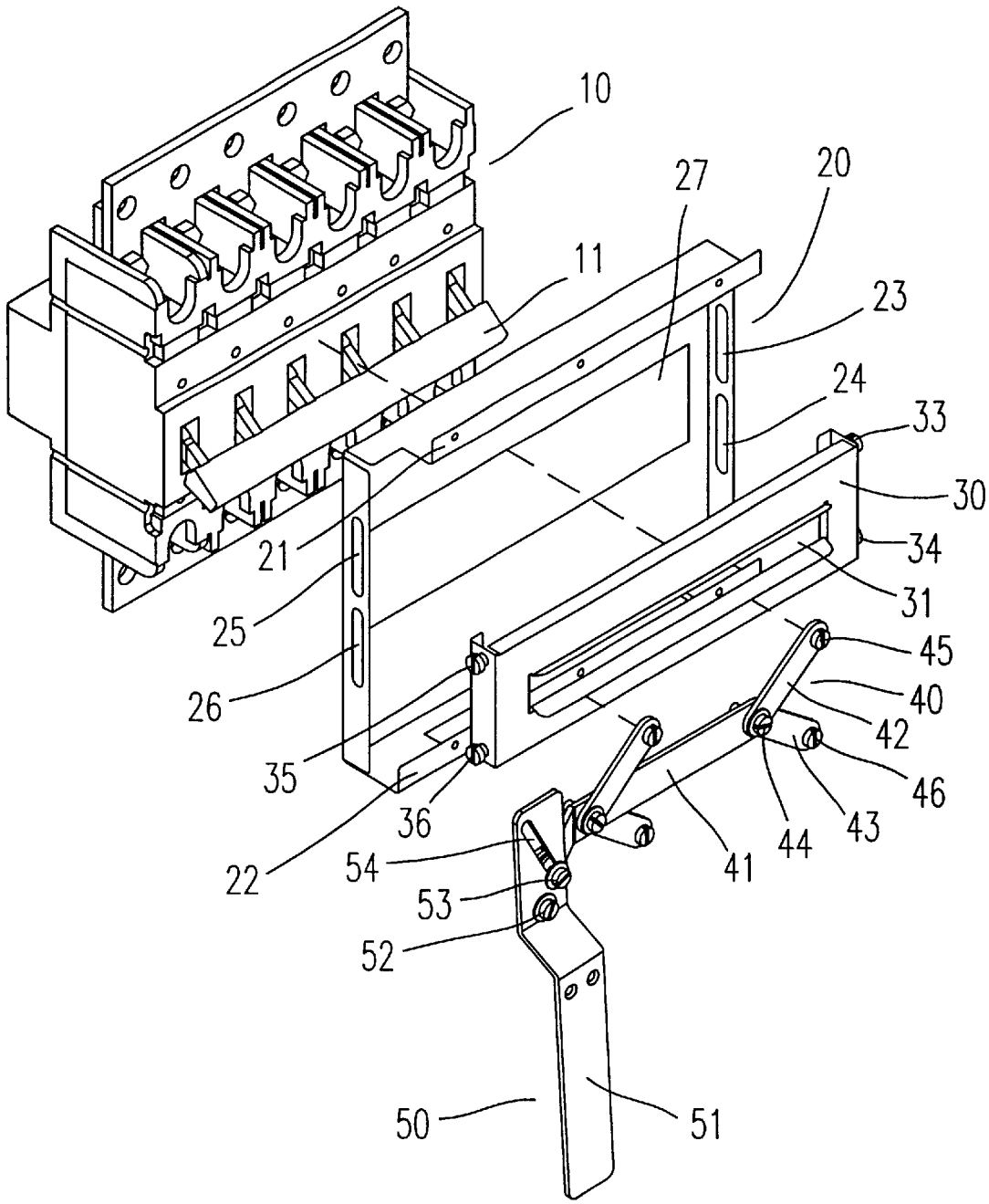
FIG. 2 is an exploded view of a handle operating mechanism according to a preferred embodiment of the present invention.

Please refer to FIG. 2. The handle operating mechanism of the present invention is employed to operate a pivot handle 11 of a multi-pole circuit breaker 10. The handle operating mechanism includes a fixed portion 20, a movable portion 30, a driven portion 40 and a manual portion 50.

The manual portion 50 includes a stem 51. The stem 51 includes a first connecting device 52 coupled with the outside surface of a panel (not shown) and a second connecting device 53 coupled with the driven portion 40. The stem 51 also includes a first passage 54. When the stem 51 is rotated, the first connecting device 52 is used as a fulcrum and the second connecting device 52 moves linearly along the first passage 54.

The driven portion 40 includes a horizontal bar 41, two first sticks 42 and two second stick 43. The horizontal bar 41, each first stick 42 and each second stick 43 are coupled together via a third connecting device 44. The first stick 42 is further coupled with the movable portion 30 via a fourth connecting device 45, and the second stick 43 is further coupled with the fixed portion 20 via a fifth connecting device 46. It is of course that the number of the first sticks 42 or the second sticks 43 can be 1 or more than 2.

The fixed portion 20 is principally a rectangular frame having two plates 21 and 22 extending from a top edge and a bottom edge thereof, respectively. Both of the plates 21 and 22 are coupled with the inside surface of a panel (not shown) via an assembly of screw bolt and nut (not shown). The fixed portion 20 has a window 27 for passing the pivot handle 11 therethrough. The height of the window 27 is approximately equal to the distance for the pivot handle 11 to move between the on position and the off position. The fixed portion 20 further has two second passages 23 and 24 on one side thereof and two second passages 25 and 26 on the other side thereof.

The movable portion 30 includes an opening 31 in the center thereof such that the pivot panel 11 could be inserted therethrough. Both sides of the opening 31 have sixth connecting devices 33, 34, 35 and 36 corresponding to the second passages 23, 24, 25 and 26. The connecting devices 33, 34, 35 and 36 move linearly along the second passages 23, 24, 25 and 26.

In this embodiment, each of the first connecting device 52, the second connecting device 53, the third connecting device 44, the fourth connecting device 45, the fifth connecting device 46 and the sixth connecting device 33 to 36 is selected from an assembly of screw bolt and nut, or a pin.

Figure 3A:
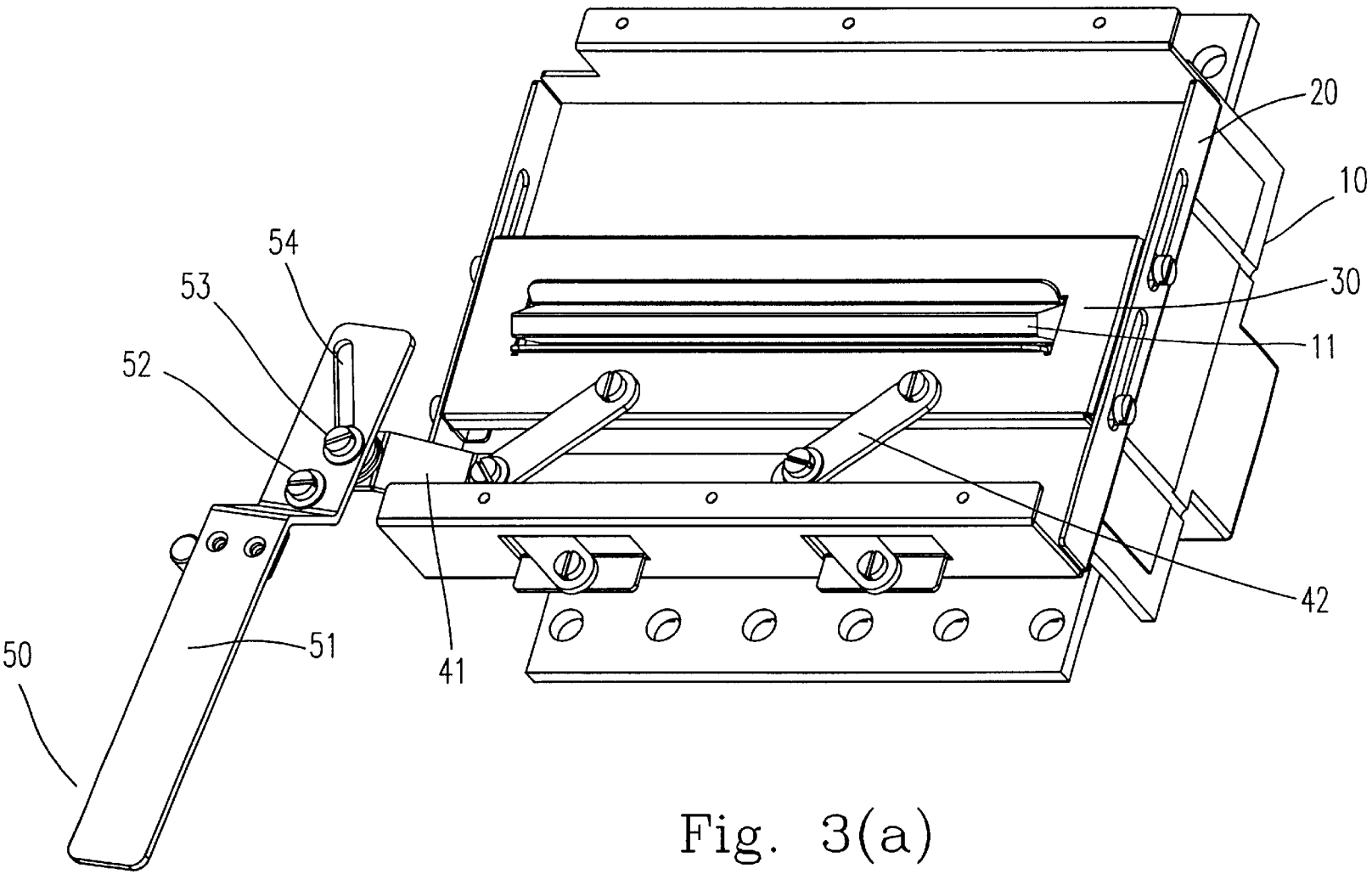
FIG. 3(*a*) is perspective view illustrating the handle operating mechanism is securely held in an off position according to the present invention.
Figure 3B:
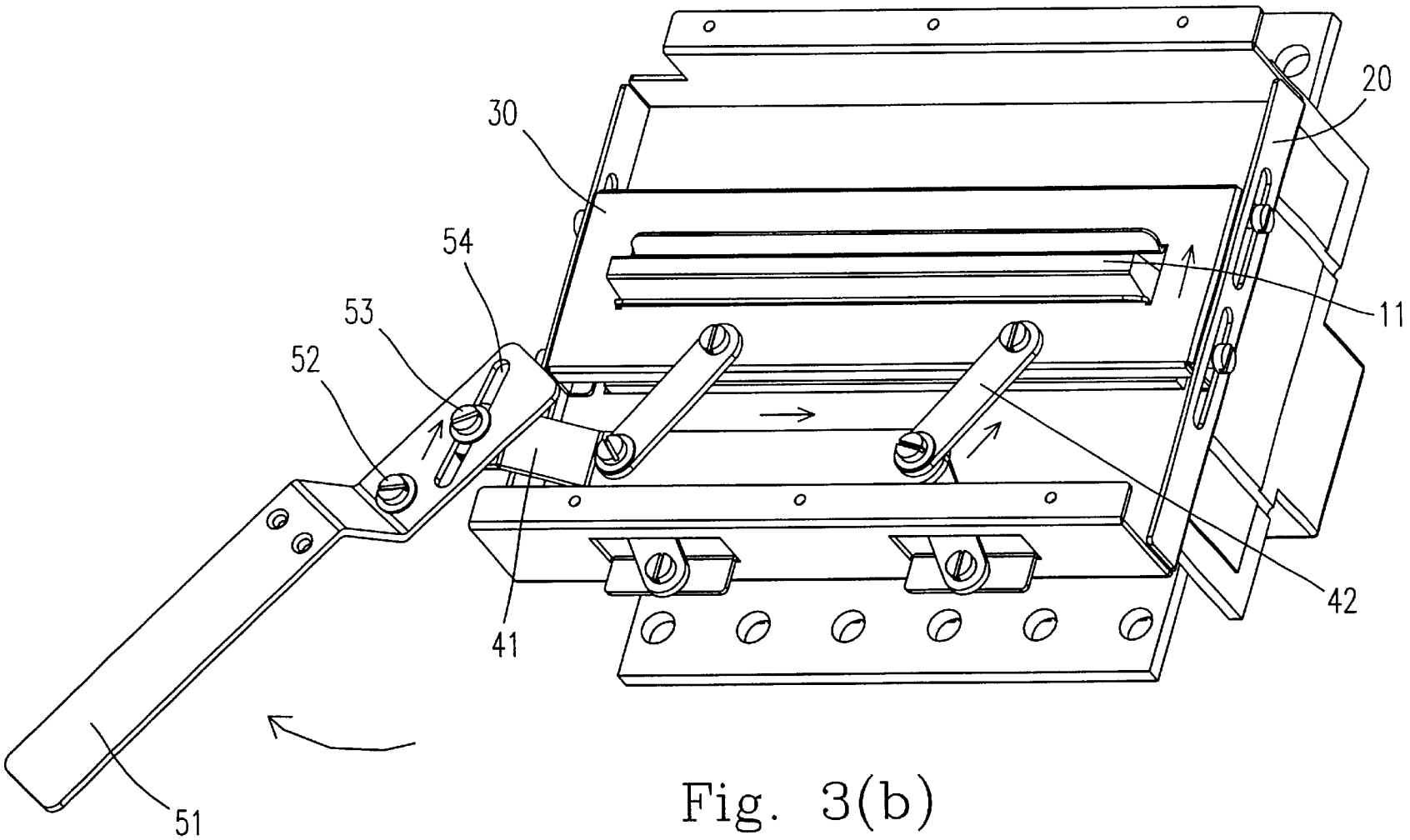
Figure 3C:
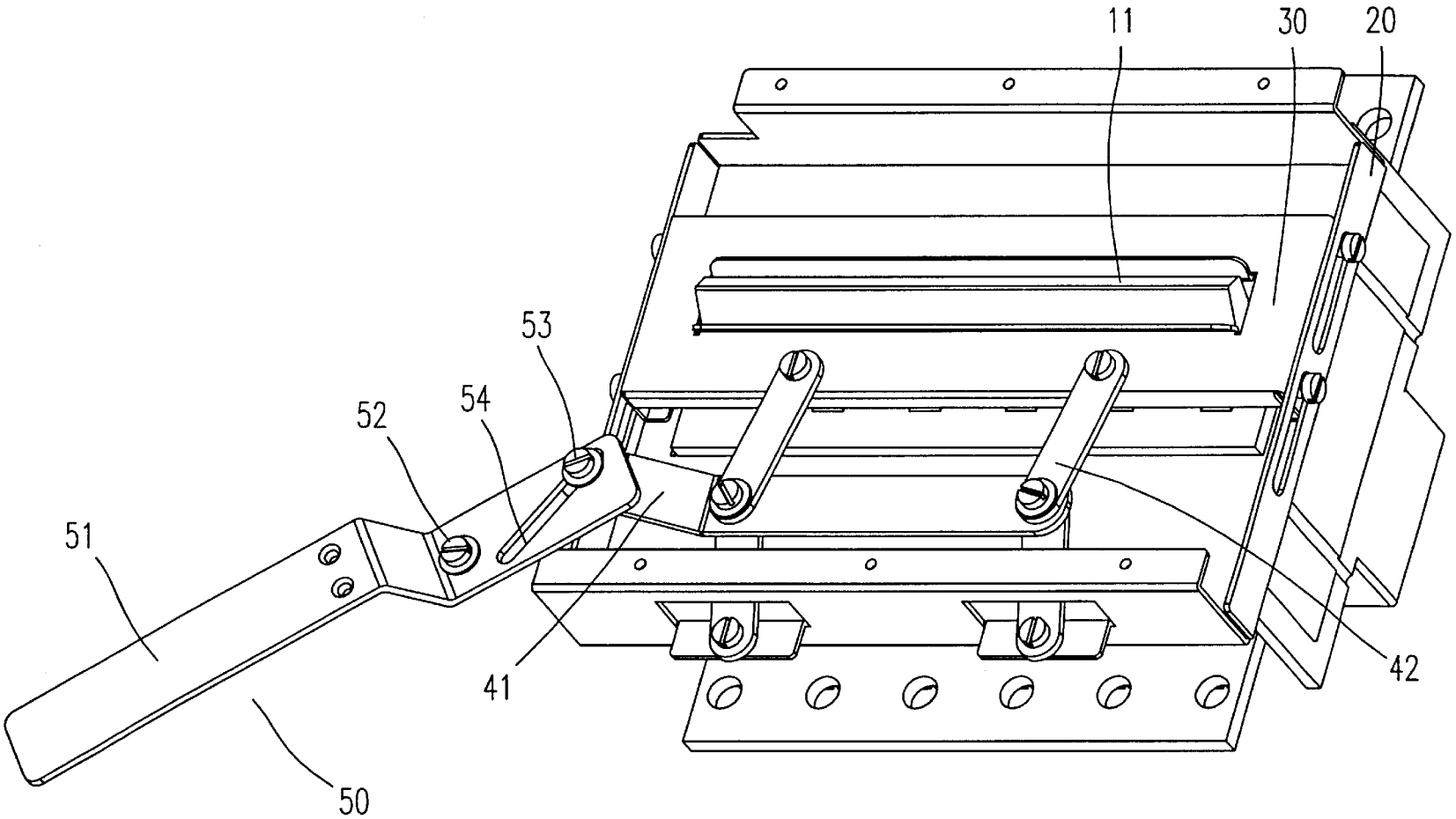

FIGS. 3(*a*), 3(*b*) and 3(*c*) are views illustrating the operation of the handle operating mechanism according to the preferred embodiment of the present invention. In FIG. 3(*a*), the pivot handle 11 of the circuit breaker 10 is securely held in an off position. In FIG. 3(*b*), when the stem 51 is rotated clockwise, the first connecting device 52 is used as a fulcrum and the second connecting device 52 moves linearly along the first passage 54. Meanwhile, the horizontal bar 41 is driven to move right and the first stick 42 moves up, thereby driving the movable portion 30 to move up. Therefore, the pivot handle 1 moves up. Referring to FIG. 3(*c*), the stem 51 is continuously rotated. Until the second connecting device 53 moves to the top end of the first passage 54, the pivot handle 11 is securely held in the on position. As well, when the stem 51 is rotated counterclockwise, the second device 53 moves to the bottom end of the first passage 54 and thus the pivot handle 11 is securely held in the off position.

Figure 4:
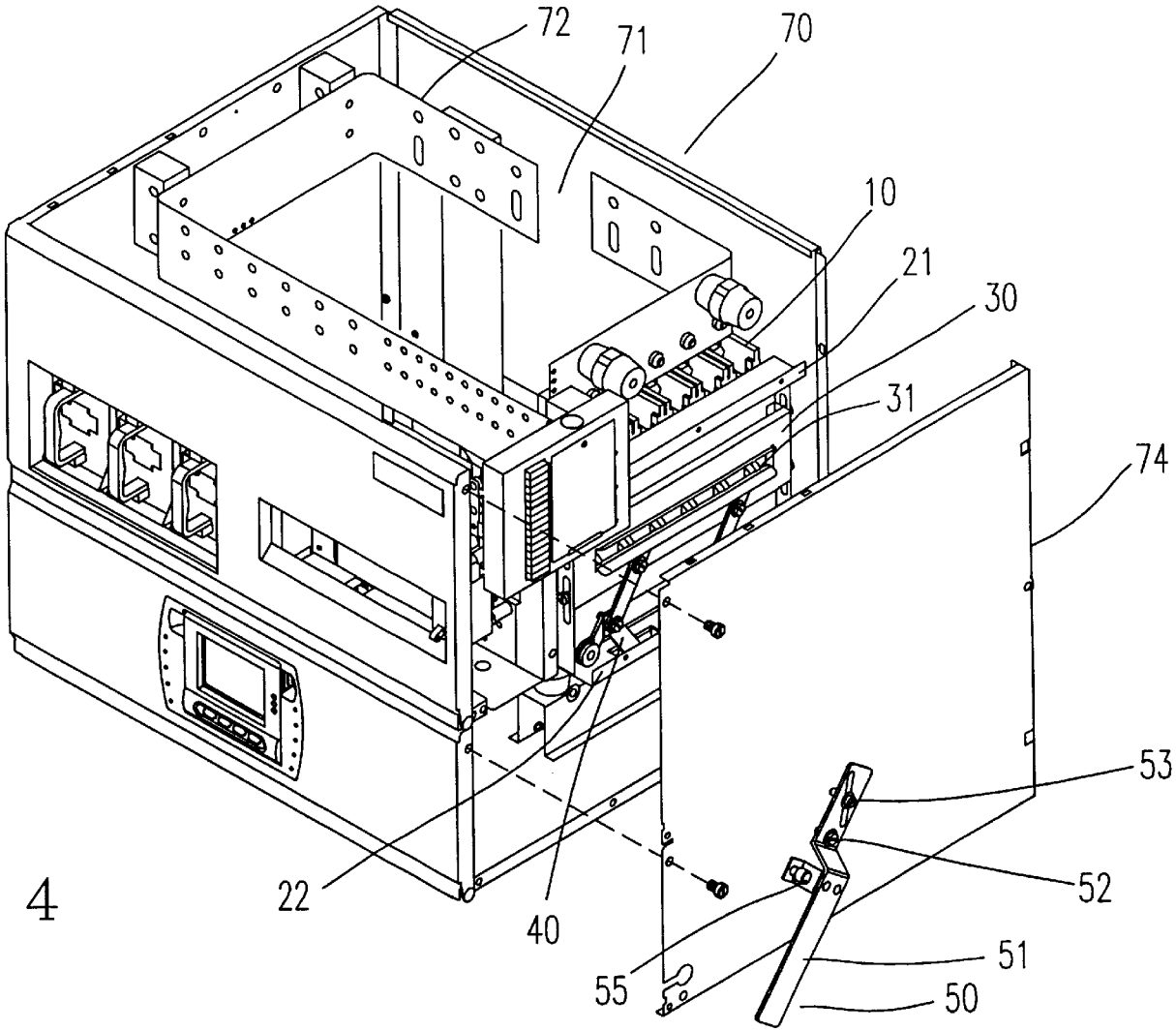
FIG. 4 is an exploded view illustrating the handle operating mechanism according to the present invention is mounted on a power distribution unit.

FIG. 4 is an exploded view illustrating the handle operating mechanism of the present invention is mounted on a power distribution unit (PDU) 70 of a communication power supply. The interior 71 of the power distribution unit 70 has a plurality of electric components such as a bus bar 72 and a multi-pole circuit breaker 10. The principle and the layout of the power distribution unit are known to a person skilled in the art. The plates 21 and 22 are coupled with the inside surface of a panel 74 via an assembly of screw bolt and nut (not shown). The circuit breaker 10, the movable portion 30 and the driven portion 40 are mounted in the interior 71 of the power distribution unit 70, while the manual portion 50 is disposed on the outside surface of the panel 74. Operators could turn on or turn off the circuit breaker 10 by rotating the stem 51 outside the power distribution unit 70. Certainly, the manual portion 50 can further include a safety pin 55 disposed on the stem 51. The safety pin 55 can be securely fixed on the panel 74 if the circuit breaker 10 is in the off position so as to prevent the stem 51 from being rotated by mistake.

Certainly, the length of the stem 51 can optionally extend so as to increase leverage and reduce the force applied by hand.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A handle operating mechanism of a multi-pole circuit breaker mounted on an electrical appliance, comprising:

a fixed portion coupled with an inside surface of a panel of said electrical appliance;

a movable portion having an opening for passing a pivot handle of said circuit breaker therethrough;

a driven portion coupled with said movable portion; and a manual portion comprising a stem with a first passage, a first connecting device coupled with an outside surface of said panel and a second connecting device coupled with said driven portion, wherein said first connecting device is used as a fulcrum and said second connecting device moves along said first passage when said stem is rotated, wherein said stem is rotated to drive said driven portion and said movable portion such that said pivot handle is securely held in one of an on position and an off position.

2. The handle operating mechanism according to claim 1, wherein said electrical appliance is a power distribution unit (PDU).

3. The handle operating mechanism according to claim 1, wherein said fixed portion comprises a rectangular frame having a window in a center thereof.

4. The handle operating mechanism according to claim 1, wherein said driven portion comprises a horizontal bar, a first stick and a second stick, said horizontal bar, said first stick and said second stick being coupled together via a third connecting device.

5. The handle operating mechanism according to claim 4, wherein said first stick is further coupled with said movable portion via a fourth connecting device, and said second stick is further coupled with said fixed portion via a fifth connecting device.

6. The handle operating mechanism according to claim 5, wherein each of said first connecting device, said second connecting device, said third connecting device, said fourth connecting device and said fifth connecting device is an assembly of screw bolt and nut.

7. The handle operating mechanism according to claim 5, wherein each of said first connecting device, said second connecting device, said third connecting device, said fourth connecting device and said fifth connecting device is a pin.

8. The handle operating mechanism according to claim 1, wherein a side of said fixed portion further comprises at least a second passage.

9. The handle operating mechanism according to claim 8, wherein said movable portion further comprises at least a sixth connecting device corresponding to said second passage.

10. The handle operating mechanism according to claim 9, wherein said sixth connecting device is an assembly of screw bolt and nut.

11. The handle operating mechanism according to claim 9, wherein said sixth connecting device is a pin.

12. A handle operating mechanism of a multi-pole circuit breaker mounted on a power distribution unit (PDU), comprising:

a fixed portion coupled with an inside surface of a panel of said power distribution unit (PDU), said fixed portion comprising a rectangular frame having a window in a center thereof;

a movable portion having an opening for passing a pivot handle of said circuit breaker therethrough;

a driven portion coupled with said movable portion, said driven portion comprising a horizontal bar, a first stick and a second stick; and a manual portion comprising a stem with a first passage, a first connecting device coupled with an outside surface of said panel and a second connecting device coupled with said driven portion, wherein said first connecting device is used as a fulcrum and said second connecting device moves along said first passage when said stem is rotated, wherein said stem is rotated to drive said driven portion and said movable portion such that said pivot handle is securely held in one of an on position and an off position.

13. The handle operating mechanism according to claim 12, wherein said first stick and said second stick are coupled together via a third connecting device.

14. The handle operating mechanism according to claim 13, wherein said first stick is further coupled with said movable portion via a fourth connecting device, and said second stick is further coupled with said fixed portion via a fifth connecting device.

15. The handle operating mechanism according to claim 14, wherein each of said first connecting device, said second connecting device, said third connecting device, said fourth connecting device and said fifth connecting device is an assembly of screw bolt and nut.

16. The handle operating mechanism according to claim 14, wherein each of said first connecting device, said second connecting device, said third connecting device, said fourth connecting device and said fifth connecting device is a pin.

17. The handle operating mechanism according to claim 12, wherein a side of said fixed portion further comprises at least a second passage.

18. The handle operating mechanism according to claim 17, wherein said movable portion further comprises at least a sixth connecting device corresponding to said second passage.

19. The handle operating mechanism according to claim 18, wherein said sixth connecting device is an assembly of screw bolt and nut.

20. The handle operating mechanism according to claim 18, wherein said sixth connecting device is a pin.

* * * * *